United States Patent [19]

Lonati

[11] 4,269,044

[45] May 26, 1981

[54] CIRCULAR KNITTING MACHINE

[75] Inventor: Francesco Lonati, Brescia, Italy

[73] Assignee: Costruzioni Meccaniche Lonati S.p.A., Brescia, Italy

[21] Appl. No.: 21,536

[22] Filed: Mar. 19, 1979

[30] Foreign Application Priority Data

Mar. 22, 1978 [IT] Italy ..... 21504 A/78

[51] Int. Cl.[3] ..... D04B 15/16

[52] U.S. Cl. ..... 66/56

[58] Field of Search ..... 66/56

[56] References Cited

FOREIGN PATENT DOCUMENTS

| | | | |
|---|---|---|---|
| 78891 | 1/1971 | German Democratic Rep. | 66/56 |
| 593147 | 10/1947 | United Kingdom | 66/56 |
| 1033157 | 6/1966 | United Kingdom | 66/56 |

*Primary Examiner*—Wm. Carter Reynolds

*Attorney, Agent, or Firm*—Guido Modiano; Albert Josif

[57] ABSTRACT

A circular knitting machine in which for switching from continuous rotary motion to reciprocating motion and vice versa there is provided a coupling member rotatively rigid with a shaft and axially displaceable between two pinions, idly arranged on the shaft. One pinion is constantly reciprocated by a reciprocable toothed sector, while the other pinion is constantly rotated. The coupling member is alternately engageable with a respective one of the pinions, so as to cause the shaft, which is operatively connected to the needle cylinder(s), to reciprocate or rotate. A control lever is pivoted to the stationary structure of the machine and has one end slideably engaging the coupling member and the other end slideably engaging two rotatable cams, which provide angular displacement of the control lever to cause axial displacement of the coupling member. The cams can be uncoupled from a cam driving shaft rotated by the main drive of the machine.

7 Claims, 6 Drawing Figures

CIRCULAR KNITTING MACHINE

This invention relates to a circular hose knitting machine having improved means for switching from continuous rotary motion of the needle cylinder or cylinders to the reciprocating motion thereof, and vice versa.

To perform such a switching action, as required for example when shifting from the knitting of a stocking leg portion to the knitting of the heel portion, and then to the knitting of the sole portion thereof, conventional machines are usually provided with a device which includes two pinion gears, mounted idle on a driven shaft and respectively meshing with a gear wheel, which is driven with continuous rotary motion by the machine main motor means, and with a gear segment, which is caused to rock continuously by the machine motor means. The two pinions are alternately engageable for rotation with the shaft which also drives a bevel gear pair through which the motion is transmitted to the needle cylinder(s) of the machine. The engagement of one pinion gear with the shaft establishes the continuous rotary motion mode, whereas the engagement of the other pinion gear with the shaft establishes the reciprocating motion mode.

To ensure this type of engagement relationship, a cylindrical coupling member is provided which is rotatively rigid with the shaft and axially displaceable along the same between the two pinion gears, said member rotatively engaging either pinion gear. The axial displacement of the coupling member is controlled by means of a lever which is journalled with one end to the stationary structure of the machine and connected at an intermediate point thereof to the coupling member such as to allow the latter to rotate, the control lever being engageable at its other end alternately with two pickers, which are movable under the action of respective cams for imparting to the lever the required amount of movement in one direction or the other.

The cams are arranged at the periphery of two disks which are rigid with a continuously rotating common shaft and are provided each with a contour profile having an inclined portion in the axial direction, the inclined portions of the two cams being oriented one towards the other and being operative to shift the respective picker and control lever. The pickers are in operation alternately, being alternately raisable to a rest position, whereat they do not interfere with their respective cam. The operational movement of the two pickers is controlled by the main drum of the machine whenever shifting from one motion of the cylinder(s) to the other is required. Upon completion of the displacement, the pickers remain in contact with the disk surface until a fresh motion switch or shift command is issued.

For constructional and mechanical reasons, it is necessary that the inclined portions of the two cams be quite steep. In fact, owing to the two pinion gears having appreciably different diameters (this in order to minimize the size of the rocking segment while permitting reciprocation of the cylinder(s) through 360°), and since the peripheral speed of the rocking or oscillating segment is not constant, during the switching step, while one pinion gear is not yet disengaged and the other is already engaged with the coupling member, the two pinion gears are simultaneously made rigid with each other and in engagement with members adapted for imparting thereto different rotational speeds, thereby it becomes necessary to make such switching very rapidly executed in order to reduce the stressing of the actuating members during the switching, which would otherwise result in a rapid wear of the members themselves and their supports. On the other hand, the very steep angle of the cam inclined portions is itself a cause of wear of the cams and of the members in engagement therewith, additionally to causing considerable stress of the machine motor means.

To make the inclined portions of the cams less steep, for a given switching time duration, or to improve the switching time duration for a given inclination, the diameter of the disks whereon the cams are positioned would have to be increased, but this is normally made impossible by considerations of bulk dimensions. However, even when space is no problem, an increased diameter of the disks would involve increased spacing of the disk and cam carrying shaft from the pinion gear carrying shaft, which would imply a corresponding extension of the control level of the coupling member; however, this would in turn require an increased movement, for a given angular movement of the lever, of that end of the control level which is located at the cams, or in other words require an increase of both components of the cam inclined portions, and therefore afford no appreciable reduction of the inclination angle nor any improvement of the switching time duration.

This invention sets out to solve the problem of providing a quick switching from continuous rotary motion to reciprocating motion, and vice versa, in a circular knitting machine for stockings and the like articles, without undergoing any appreciable wear of the members performing that switching.

It is a further object of the invention to provide a switching device as above, which is constructionally simple, reliable in operation, and of more economical operation than conventional devices of this type.

These objects are achieved by this invention in that a circular knitting machine for stocking and the like articles is provided having means for switching from the continuous rotary motion of the needle cylinder or cylinders to the reciprocating motion thereof, and vice versa, said means comprising a pair of pinion gears idly mounted on a shaft operatively connected to the machine needle cylinder(s) and respectively meshing with gear wheel, driven with constant rotary motion by the machine main motor means, and with a gear segment, caused to rock continuously under the action of the machine main motor means, and a coupling member rotatively rigid with said shaft and axially displacable along said shaft between said pinion gears for alternate engagement therewith, said alternate engagement being controlled by means of a control lever through a rotating cam type of control rotatively driven by the machine main motor means, the machine being characterized in that said control lever has one end in engagement with said coupling member and the other end in engagement with said rotating cams, and is journalled to the machine stationary structure at an intermediate point of the lever length, and in that said rotating cam control, being driven at the same rotational speed as the machine needle cylinder(s), is controllably uncoupleable from the machine main motor means.

In a machine of this type, wherein the control lever is entirely contained in the space between the cams and coupling member, with its ends in engagement relationship with said components, it becomes possible to limit the travel distance of the cam controlled lever end and maintain it in the same order of magnitude as the coupling member travel distance, while permitting ample increase limits for the cam diameters, by virtue of the space availability resulting from arranging the lever between the cams and coupling member. Both provisions result in a reduced steepness of the cam inclined portions. As a consequence, less wear is experienced with the cams for a given switching time duration, while such switching time can be improved over conventional devices without resorting to the steep angles of the cams in such conventional devices. The fact that the cam control can be uncoupled from the machine motor means permits the cams to be held stationary during the fabric knitting process, thus reducing cam wear, while the pickers of the traditional devices are entirely eliminated.

Further features and advantages of the invention will be more clearly apparent from the following detailed description of a preferred embodiment thereof, given herein by way of example only, in conjunction with the accompanying illustrative drawings, where:

Figure 1:
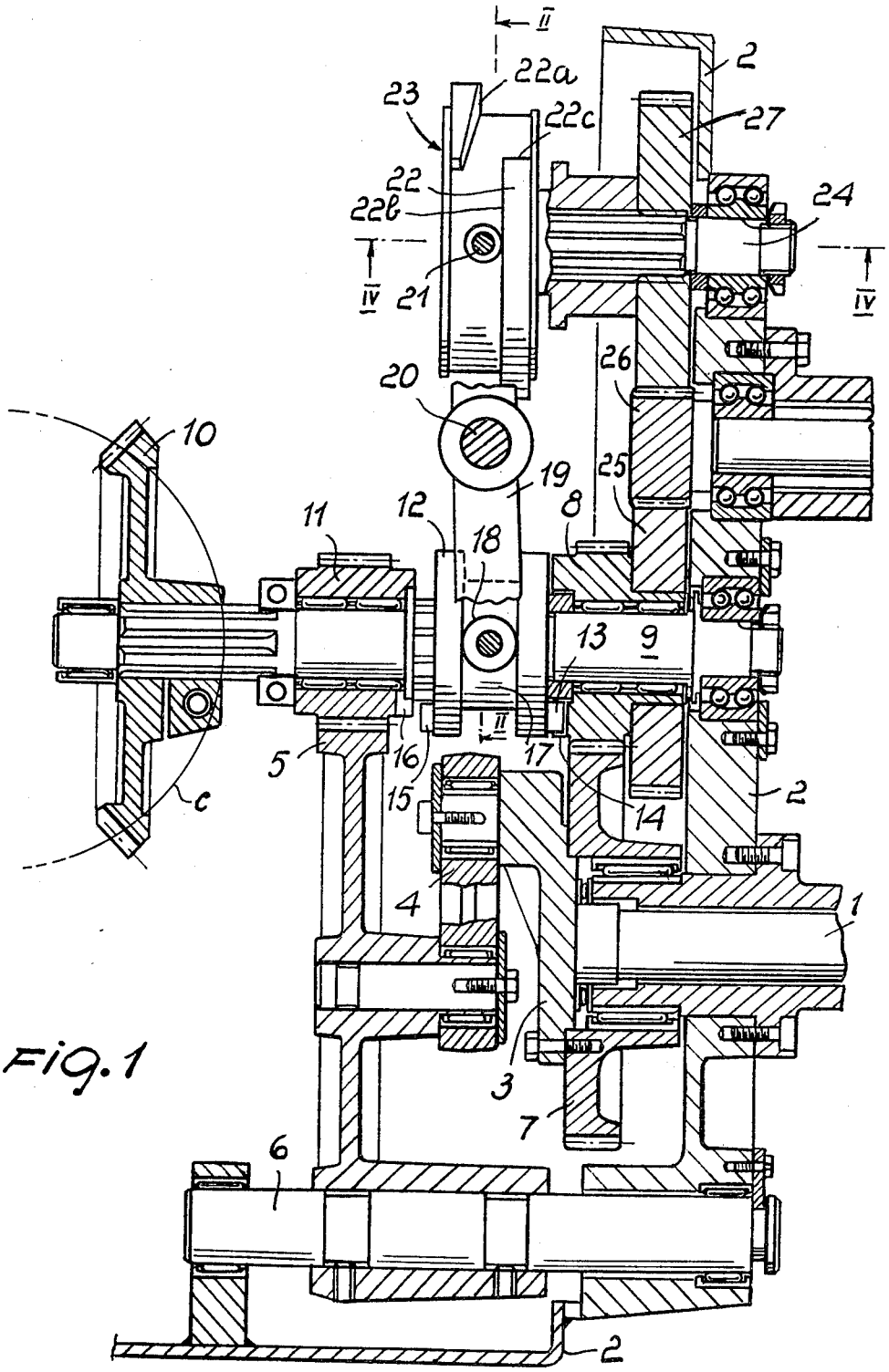
FIG. 1 is a sectional view, taken in a horizontal plane through the switching means of a circular hose knitting machine according to the invention.
Figure 2:
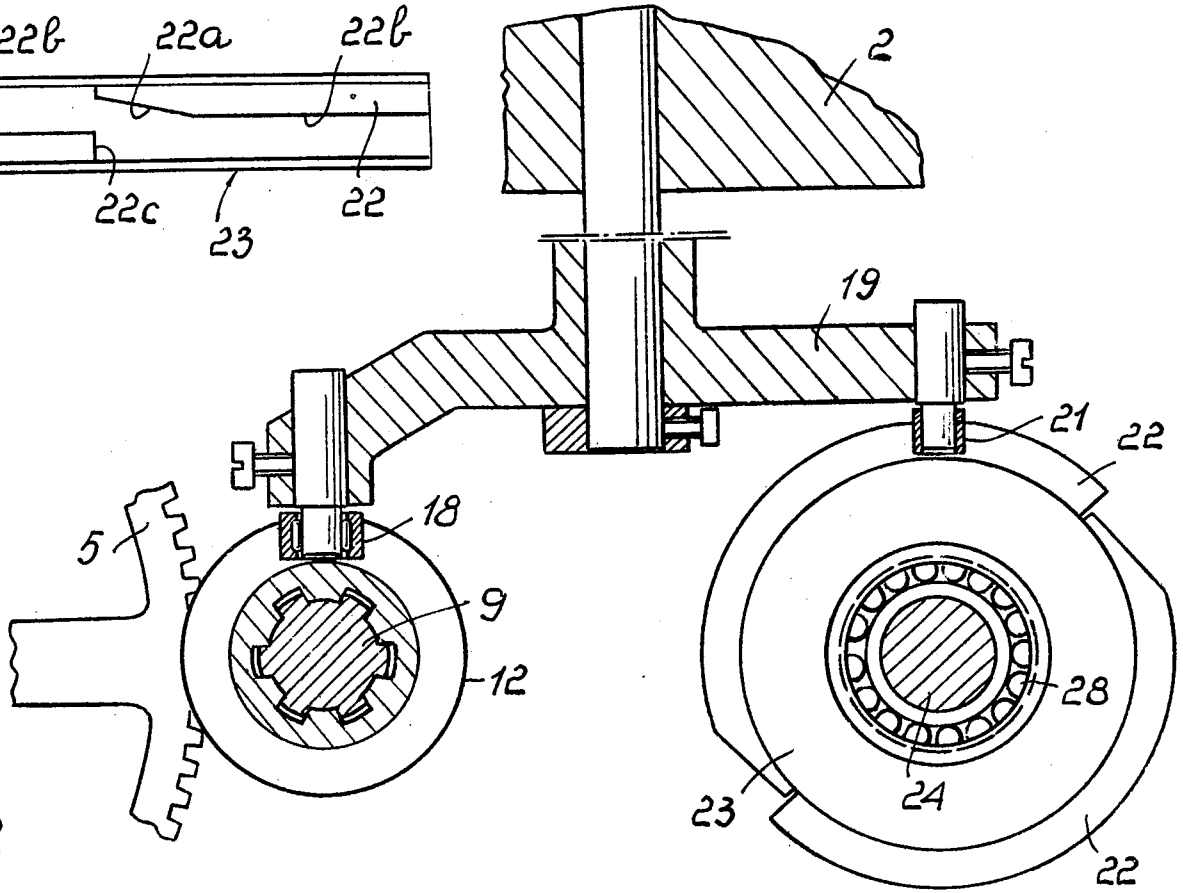
FIG. 2 is a sectional view taken along the line II—II of FIG. 1.
Figure 3:
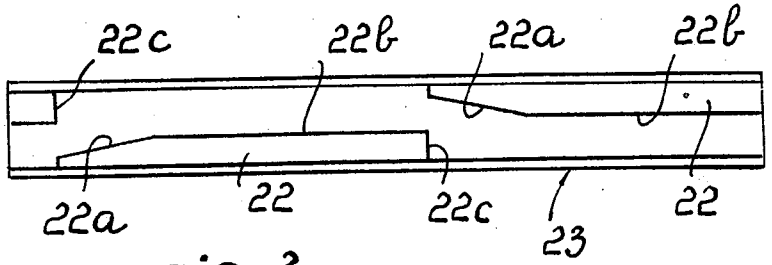
FIG. 3 is a development representation of the cam pattern of the rotating cam control.

With reference first to FIG. 1 of the drawings, the switching means according to the invention derive their motion from a shaft 1 making part of the machine main driving means and journalled in the stationary structure 2 of the machine. To the shaft 1, a crank-like appendage 3 is made rigid wherethrough the motion is transmitted, via an intervening connecting rod 4, to the gear segment 5, which is journalled to the stationary structure 2 by means of a pivot pin 6. Owing to the spacing of the pivot centers of the connecting rod 4 being larger than the distance between the axis of the shaft 1 and the pivot center of the connecting rod on the crank-like appendage 3, the rotary motion of the appendage 3 is converted into a rocking or oscillatory movement of the gear segment 5, in a mannner known per se.

A gear wheel 7 is rigid with the appendage 3 which is coaxial with the shaft 1 and in constant mesh with a first pinion gear 8, mounted idle on a driven shaft 9 which is rotatably supported by the stationary structure 2 of the machine, at one end, and has, at its other end, a bevel gear 10 driving, in a manner known per se, the needle cylinder(s) C, not shown. The ratios are such that one revolution of the pinion gear 8 results in one revolution of the cylinder(s).

On that same driven shaft 9, there is arranged a second idle pinion gear 11, spaced apart from the first and in constant mesh with the gear segment 5. The pitch diameter of the pinion gear 11 is slightly smaller than the pitch diameter of the pinion gear 8, and correspondingly, the pitch diameter of the gear segment 5 is slightly larger than the pitch diameter of the gear wheel 7, in a manner known per se. It will be appreciated then, that the pinion gear 8 is caused to rotate continuously, whereas the gear pinion 11 is reciprocated continuously, the ratios being such that the reciprocating motion transmitted to the cylinder(s) extends over 360° in a manner also known in the art.

In order to drive the shaft 9 (and accordingly the cylinder, or cylinders) alternately with continuous rotary motion and reciprocating motion, a cylindrical coupling member 12 is provided which is rotatively rigid with the shaft 9 but axially displaceable along the same between a position whereat at least one tooth 13 of one end thereof engages at least one seat 14 provided in the facing side surface of the pinion gear 8, and a position whereat at least one tooth 15 of its other end engages at least one seat 16 in the facing side surface of the pinion gear 11, the amount of such displacement being such that in normal operating conditions the coupling member 12 only engages one of the two pinion gears. It will be appreciated that, in this way, the shaft 9 is made respectively rigid with the gear wheel 7, and then it rotates with continuous rotary motion, or with the gear segment 5, and then it is caused to move with reciprocating motion.

The coupling member 12 is formed with a centrally located peripheral groove 17, which accommodates permanently a roller 18 having its axis orthogonal to the axis of the coupling member 12. The roller 18 is carried rotatably on one end of a control lever 19, centrally journalled in the stationary structure 2 of the machine by means of a pivot pin 20 such as to be oscillable in a horizontal plane. To the other end of the lever 19 another roller 21 is journalled, again along a vertical axis, which engages alternately with two cams 22 located at the periphery of a drum 23 on opposite sides of the roller 21 and astride the drum centerline. The drum is positioned with its axis parallel to the axis of the driven shaft 9. The two cams 22 extend each substantially over a half circle and have each an initial portion **22*a* inclined in the axial direction from the outside towards the inside and a rectilinear portion 22*b*, terminating in an orthogonal end portion 22*c*. The rectilinear portion 22*b* of the two cams 22 is arranged on the drum 23 at an axial position such as to produce respectively two angular positions of the lever 19 corresponding each to one of the two coupling conditions of the coupling member 12, i.e. engagement with the pinion gear 8 when the roller 21 engages the portion 22*b* of one of the cams 22, and engagement with the pinion gear 11 when the roller 21 engages the portion 22*b* of the other cam 22**.

The drum 23 is carried by a cam driving shaft 24, which defines the axis of rotation of the drum and which is in turn carried rotatably by the stationary portion 2 of the machine and caused to rotate by the pinion gear 8 through a set of gear wheels 25,26 and 27, the first being coaxial and rigid with the pinion gear 8, the second being an idler, and the third being rigid with the shaft 24 and equal to the wheel 25. Therefore, the shaft 24 is in constant rotation, at a 1:1 speed ratio to the pinion gear 8.

The drum 23 can be controllably coupled with, and uncoupled from the driving means defined by shaft 24 through a coupling assembly shown schematically in FIGS. 4 to 7. Specifically, the drum 23 is idle on the shaft 24, through bearings 28, and carries rigid and coaxial therewith a disk 29 having two diametrically opposed peripheral stop notches 30 adapted for accommodating a small tooth 31 of a stop lever 32. This lever is pivoted with one end at 33 to the stationary structure 2 of the machine and held in contact with the periphery of the disk 29 by a spring 34 stretched between the other end of the lever 32 and a fixed pin 35. The notches 30 and small tooth 31 are so shaped as to allow the disk 29 to only rotate in the direction of the arrow in FIG. 6, corresponding to the direction of rotation of the shaft 24.

To the disk 29, there is pivotally connected, about a pivot parallel to the axis of rotation of the disk 29 and drum 23, an entrainment pawl 36 having an outer substantially arcuate portion 37 on one side of the pivot center defined by said pivot, and an inner entrainment tooth 38 on the opposite side of the pivot center. To this same side one end of a spring 39 is also attached which has its other end anchored to an anchor pin 40 rigidly mounted to the disk 29.

Externally to the disk 29, in the same plane as the pawl 36, there are arranged two control fingers 41, at diametrically opposite positions, each finger being journalled to a fixed pivot pin 42 extending parallel to the axis of the disk 29, and adapted for occupying either of two positions under control by a respective Bowden cable 43: namely, a rest position wherein the cable 43 is relaxed and the finger contacts a stop 44 (or the stop 35 in the case of the lower finger 41) under the action of a torsion spring 45, and an operative position wherein the cable 43 is tightened and the finger 41 is away from its stop. In the rest position, the end of the finger 41 is adapted for engaging the arcuate portion 37 of the pawl 36, as shown in FIG. 5 for the upper finger 41.

Rigid with the driveshaft 24 is a sleeve body 46 provided with a flange in the plane of the pawl 36, the flange having two diametrically opposed notches 47 the shape whereof mates the shape of the small tooth 38 of the pawl 36, i.e. comprises an inclined portion and a radial portion which is arranged to follow the inclined portion in the direction of rotation of the shaft 24.

Figures 4, 5:
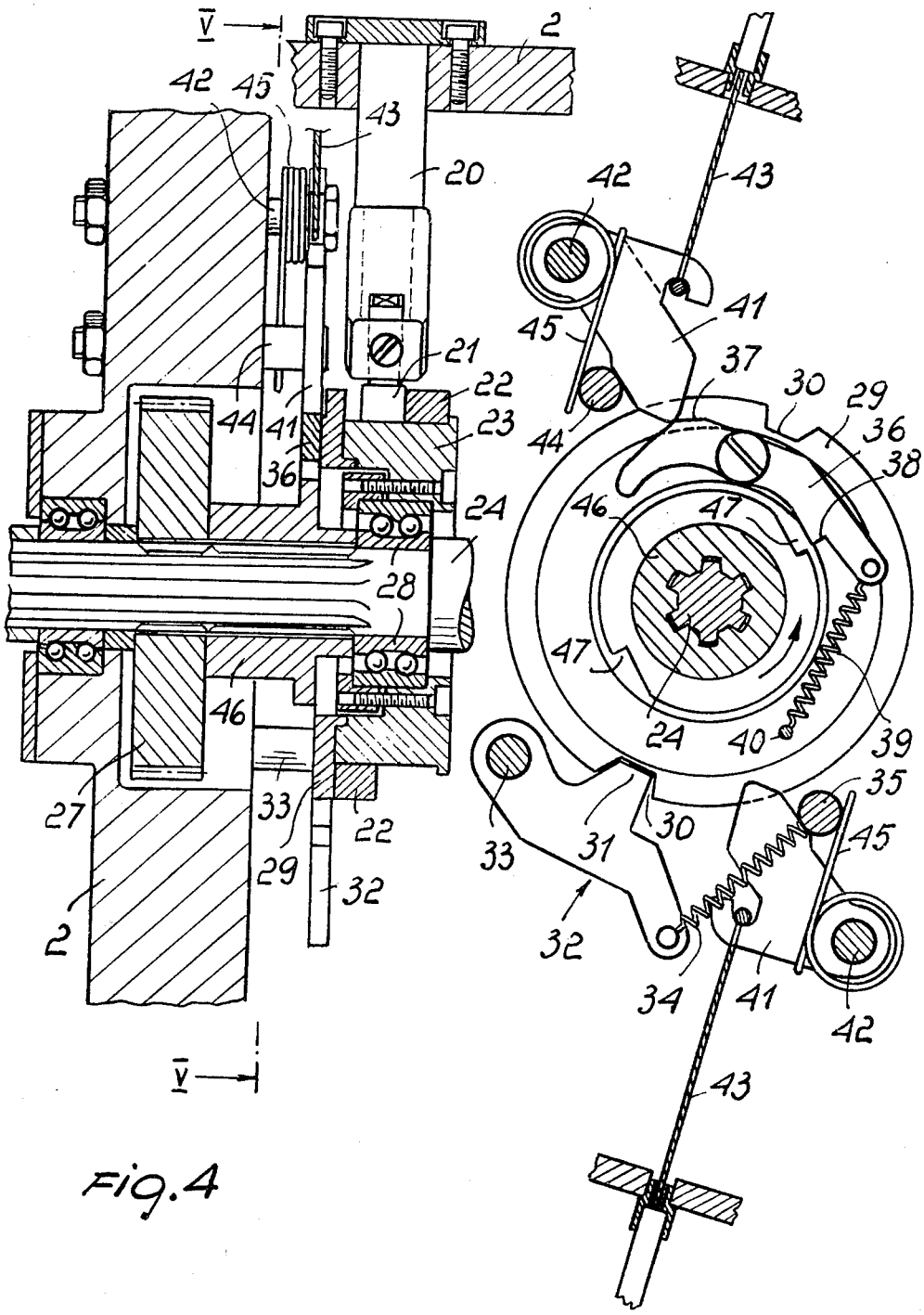
FIG. 4 is a vertical section along the line IV—IV of FIG. 1.
FIGS. 5, 6 and 7 are views of the coupling assembly for actuating and de-actuating the cam control at different operational stages, in section along the line V—V of FIG. 4.
Figure 6:
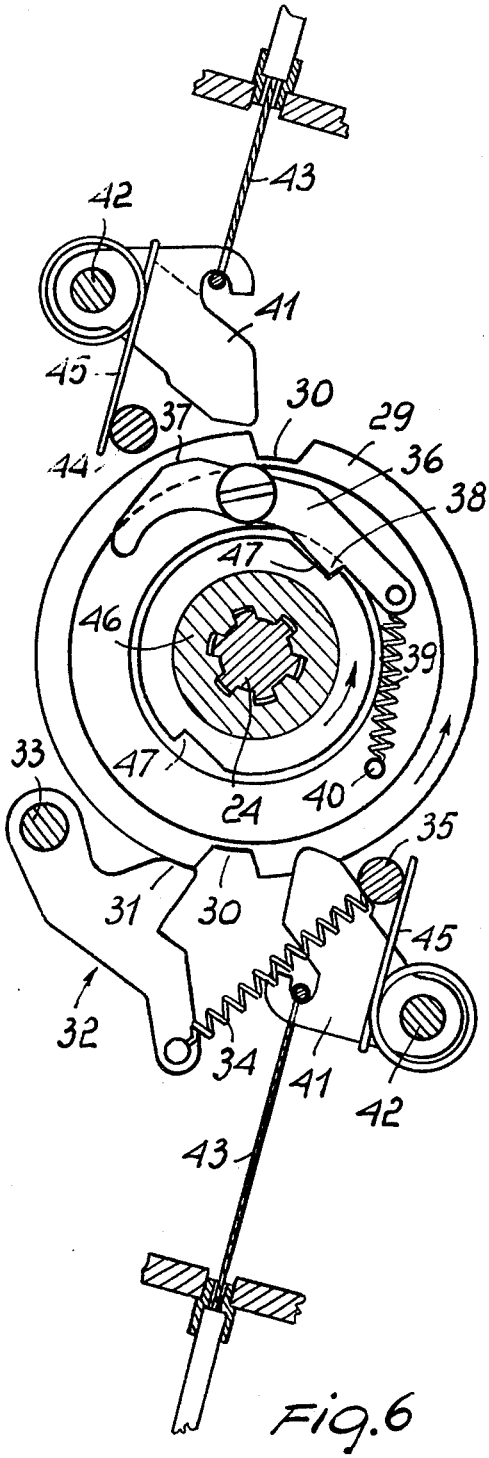

In normal conditions, upon the small tooth 31 on the stop lever 32 engaging one of the notches 30, the arcuate portion 37 is engaged by one of the control fingers 41, as shown in FIG. 5. In this condition, the small tooth 38 is disengaged from the sleeve body 46, thereby the assembly comprising the disk 29 and drum 23 is stationary, whereas the shaft 24 continues to rotate. The roller 21 is in engagement with the rectilinear portion **22*b* of one of the two cams 22, thus holding the control lever 19 in an angular position suitable to cause the coupling member 12 to either engage the pinion gear 8 (as shown in FIG. 1) or the pinion gear 11. It will appear from the above how in the one case a continuous motion is transmitted to the shaft 9**, and in the other case a reciprocating motion is transmitted thereto.

Figure 7:
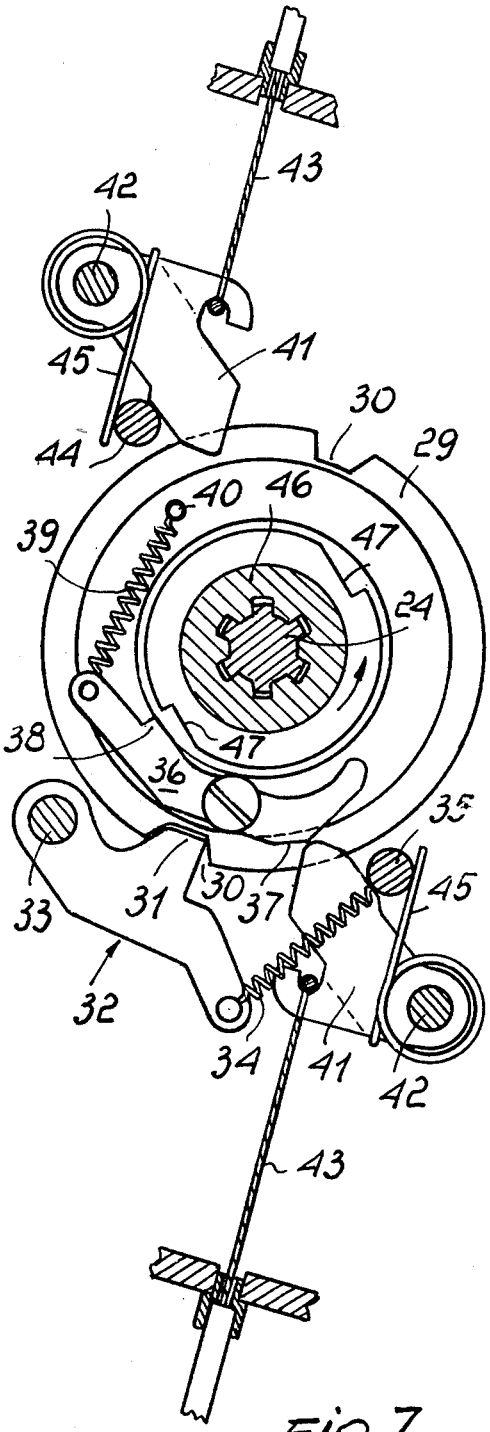

To switch from one type of motion to the other, it will suffice to actuate the Bowden cable 43 associated with the control finger 41 which in that moment withholds the pawl 36 (FIG. 6), thereby the pawl itself is released and brings, under the action of the spring 39, its small tooth 38 to insert itself in the first of the notches 47 which happens to move past the small tooth itself during the continuous rotation of the body 46 together with the shaft 24. Thus, the disk 29 and drum 23 are made to rotate, and this continues until the outer arcuate portion 37 reaches, after a half revolution, the other control finger 41, which is in its rest position, said finger causing the pawl 36 to return to its original position, to uncouple the small tooth 38 from the notch 47 in the body 46 (FIG. 7). Thus, the drum 23, and accordingly the cams 22, is caused to perform a half revolution rotational movement, and consequently the other cam 22 is brought into engagement with the roller 21, initially along its inclined initial portion **22*a* and then along the rectilinear one 22*b*, which results in a shift of the control lever 19 and coupling member 12** to the other operative coupling position.

It will be appreciated that to switch back to the previous motion condition, the same sequence of operations will be performed, except that the cable 43 is now actuated which was previously left inoperative. Thus, a further half revolution of the drum 23 and cams 22 is performed, and the previous coupling condition of the member 12 is restored. In actual practice, two cams will be provided on the machine main drum, one for controlling the pulling of one Bowden cable 43, to switch from continuous rotary motion to reciprocating motion, and the other cam for controlling the pull on the other Bowden cable 43, to perform the reverse change. The stop lever 32 maintains the operative positions.

By providing, for switching the needle cylinder or cylinders from one motion type to the other, a drum 23 of comparatively large diameter, and by locating the pivot for the lever 19 between the drum 23 and coupling member 12, it becomes possible to impart a very mild slope to the active inclined portion **22*a* of the cams 22, or in other words, to provide a very quick change over without too steep a portion, as is instead the case with conventional devices. Fast switching is effective to minimize the time lapse during which, in moving the coupling member 12 from one position to the other, the pinion gears 8 and 11 are made rigid with each other and simultaneously urged to move at different speeds owing to their engagement with the gear wheel 7 and gear segment 5, respectively, thus minimizing the consequential stress in the actuating components. Furthermore, it should be noted that the above described switching means are of improved constructional simplicity, as a result of the elimination of the two pickers provided in the conventional switching means, while less wear is experienced by the cams, consequently to the fact that in the normal conditions of operation of the machine the drum 23** of the cams is held stationary.

Advantageously, on the same shaft 24 which carries the coupling and uncoupling assembly for the drum 23, there may be arranged other similar assemblies, e.g. for controlling the striper units of a double cylinder machine, as described in U.S. application Ser. No. 950,411 corresponding to published British application No. 2,007,728 by the same applicant.

The device described hereinabove is both applicable to a single cylinder circular knitting machine and to a double cylinder one.

Naturally the invention described herein is susceptible to several modifications and variations, all of which are intended to fall within the scope of the instant inventive concept as defined in the appended claims.

I claim:

1. A circular knitting machine for stockings and like articles, having at least one needle cylinder and means for switching from continuous rotary motion of said at least one needle cylinder to reciprocating motion thereof, and vice versa, comprising a stationary structure, a driven shaft rotatably supported by said stationary structure for rotating said at least one needle cylinder, two pinion gears idly arranged on said driven shaft axially spaced from one another, a gear segment meshing with one of said pinion gears, means for causing said gear segment to perform a rocking movement for causing said one of said pinion gears to reciprocate for at least 360°, a gear wheel meshing with another of said pinion gears, means for continuously rotating said gear wheel, a coupling member rotatively rigid with said driven shaft and axially displaceable along said driven shaft between said pinion gears, means on said coupling member and said pinion gears for alternate rotational engagement with said pinion gears, a control lever having an intermediate point journalled in said stationary structure and one end slideably engaging with said coupling member for axial displacement thereof, rotatable cams slideably engaging another end of said control lever to cause angular displacement thereof and corresponding axial displacement of said coupling member for alternate rotational engagement between said coupling member and said pinion gears, driving means for rotating and rotatable cams with an angular speed corresponding to that of said driven shaft, and means for coupling said rotatable cams with, and uncoupling said rotatable cams from, said driving means.

2. A machine according to claim 1, wherein said coupling member has at the periphery thereof a groove and said one end of said control lever rotatably supports a roller entering said groove.

3. A machine according to claim 1, further comprising a drum supporting said cams, said cams comprising two cams for alternate engagement with said another end of said control lever and extending along the periphery of said drum, on opposite sides thereof, over 180° each, said cams each having an initial portion inclined in the axial direction from the outside towards the inside, a rectilinear portion following said inclined portion, said rectilinear portions of said cams being arranged on said drum at an axial position such as to provide respectively two angular positions for said control lever, one of said angular positions corresponding to a position of engagement of said coupling member with said one of said pinion gears and the other of said angular positions corresponding to a position of engagement of said coupling member with said another of said pinion gears.

4. A machine according to claim 1, further comprising a drum supporting said cams, said driving means for rotating said cams comprising a cam driving shaft idly supporting said drum and said means for coupling said rotatable cams with, and uncoupling said rotatable cams from, said driving means comprise means for coupling said drum with, and uncoupling said drum from, said cam driving shaft.

5. A machine according to claim 4, wherein said drum has an axis of rotation and said means for coupling said drum with, and uncoupling said drum from, said cam driving shaft comprise a pawl pivoted to said drum about a pivot parallel said axis of rotation of said drum, said pivot defining a pivot center for said pawl and said pawl having an outer substantially arcuate portion on one side of said pivot center and an inner entrainment tooth on the other side of said pivot center, a flange rigidly mounted for rotation with said cam driving shaft and having two diametrically opposed notches for receiving said inner tooth alternately, and control means for holding said pawl in a position whereat said inner tooth is disengaged from said notches and said drum is stationary and for releasing said pawl to a position whereat said inner tooth engages a respective one of said notches for entraining said drum rotatively.

6. A machine according to claim 5, wherein said control means comprise two control fingers located diametrically opposite with respect to said cam driving shaft in the plane of said pawl, two fixed pivot pins each pivotally supporting one of said control fingers, and means for pivotally displacing said control fingers, each at different times, between a rest position whereat a respective one of said control fingers engages said arcuate portion of said pawl while holding said inner tooth disengaged from said notches and an operative position whereat a respective one of said control fingers releases said pawl for engagement of said inner tooth with a respective one of said notches.

7. A machine according to claim 5, further comprising a disk rigid with said drum, said disk having two diametrically opposed stop notches, and a stop lever having a small tooth respectively engageable with one of said stop notches in the rest position of said control levers.

* * * * *